US005322644A

United States Patent [19]

Dunn et al.

[11] Patent Number: 5,322,644

[45] Date of Patent: Jun. 21, 1994

[54] PROCESS FOR DECONTAMINATION OF RADIOACTIVE MATERIALS

[75] Inventors: Michael J. Dunn, Roswell, Ga.; David Bradbury, Pencot; George R. Elder, Courtlea, both of United Kingdom

[73] Assignee: Bradtec-US, Inc., Atlanta, Ga.

[21] Appl. No.: 816,467

[22] Filed: Jan. 3, 1992

[51] Int. Cl.[5] ..... G21F 9/00

[52] U.S. Cl. ..... 252/626; 423/6; 423/11; 423/17; 423/18; 210/682; 210/759; 210/765; 134/3; 134/22.17; 976/DIG. 376; 376/309; 376/310

[58] Field of Search ..... 252/626; 210/759, 765; 423/3, 20, 11, 6, 17, 18; 134/3, 22.17, 36; 976/DIG. 376; 376/309, 310

[56] References Cited

U.S. PATENT DOCUMENTS

| | | | |
|---|---|---|---|
| 2,841,468 | 7/1958 | Wilson | 423/7 |
| 2,864,667 | 12/1958 | Bailes et al. | 423/7 |
| 3,000,696 | 9/1961 | Teichmann | 423/7 |
| 3,013,909 | 12/1961 | Pancer et al. | 134/3 |
| 3,025,131 | 3/1962 | Lerner | 423/20 |
| 3,047,434 | 7/1962 | Bulat | 134/1 |
| 3,080,262 | 3/1963 | Newman | 134/3 |
| 3,258,429 | 6/1966 | Weed | 252/631 |
| 3,660,287 | 5/1972 | Quattrini | 252/8.552 |
| 3,873,362 | 3/1975 | Mihram et al. | 134/3 |
| 4,200,337 | 4/1980 | Jackovitz et al. | 299/5 |
| 4,226,640 | 10/1980 | Bertholdt | 134/3 |
| 4,397,819 | 8/1983 | Yan et al. | 423/7 |
| 4,438,077 | 3/1984 | Tsui | 423/7 |
| 4,443,268 | 4/1984 | Cook | 134/2 |
| 4,624,792 | 11/1986 | Yamanaka et al. | 210/759 |
| 4,690,782 | 9/1987 | Lemmens | 252/626 |
| 4,729,855 | 3/1988 | Murray et al. | 252/626 |
| 5,122,268 | 6/1992 | Burack et al. | 210/202 |
| 5,205,999 | 4/1993 | Willis et al. | 423/20 |

FOREIGN PATENT DOCUMENTS

| | | |
|---|---|---|
| WO90/11972 | 10/1990 | PCT Int'l Appl. . |
| 2229312A | 9/1990 | United Kingdom . |

*Primary Examiner*—Donald P. Walsh
*Assistant Examiner*—Ngoclan T. Mai
*Attorney, Agent, or Firm*—Needle & Rosenberg

[57] ABSTRACT

A process for decontaminating radioactive material comprises the step of contacting the material with a dissolving composition to dissolve the contaminants in the material, said composition comprising a dilute solution of about 0.05 molar ethylene diamine tetraacetic acid, about 0.1 molar carbonate, about 10 grams per liter hydrogen peroxide and an effective amount of sodium hydroxide to adjust the pH of the composition to a pH from about 9 to about 11. Also included are the steps of separating the dissolving composition containing the dissolved contaminants from the contacted material and recovering dissolved contaminants from the dissolving composition that has been separated from the material. A composition for dissolving radioactive contaminants in a material, comprising a dilute solution having a basic pH and effective amounts of a chelating agent and a carbonate sufficient to dissolve radioactive contaminants is also provided.

24 Claims, 2 Drawing Sheets

PROCESS FOR DECONTAMINATION OF RADIOACTIVE MATERIALS

BACKGROUND OF THE INVENTION

Environmental contamination with radioactive materials is a common problem. The problem may occur as a result of mining operations, such as for uranium, or contamination due to operation of nuclear facilities with inadequate environmental controls, or from the disposal of radioactive wastes. Alternatively, contamination may occur as a result of dispersion of uranium billets which have been used as a high density material in military or civil applications as a result of warfare or civil accident.

Mining operations have established practical and economic methods for the economic recovery of some radioactive elements from contaminated materials. The objective of mining, however, is usually the economic recovery of materials and secondary waste is rarely the major issue. In environmental clean-up, the economic objective is to complete effective clean-up with minimum secondary waste at minimum cost, and the value of recovered radioactive substances is of secondary importance. Techniques and chemicals which would not be economical or appropriate for mining applications may become practical for environmental clean-up.

It is well established that radioactive elements can be recovered from environmental materials by mechanically washing with water with or without surface active additives. However, such procedures are generally limited to the mechanical separation of solids, and will not remove contaminants that are chemically bound to the solid phase.

There are established chemical methods for dissolving insoluble radioactive contaminants in concentrated solvents, such as strong acids, in a process known as acid leaching. Such procedures are effective, but are disadvantageous if the spent concentrated solution ultimately becomes waste. In many cases, the concentrated solvents themselves are hazardous in addition to containing the radioactive contaminant that the process is designed to concentrate. The acid leaching and other processes using concentrated solvents to dissolve the radioactive contaminant have the further disadvantage of also dissolving other contaminants that the process was not designed to remove, such as nonradioactive metals.

In the decontamination of internal surfaces of nuclear reactor circuits, early processes involved washing with concentrated chemical solutions to dissolve contaminants to yield a concentrated solution containing the contamination. The processing of these waste solutions was found to be difficult and inconvenient and resulted in them becoming waste and requiring disposal. The technology has now progressed to allow the recovery of radioactivity, typically by ion exchange, in a dilute acidic recirculating system. These solutions, being dilute and acidic, do not contain carbonate and are not particularly useful or appropriate for dissolving actinide elements because they do not form soluble complexes with the actinide elements.

In reactor decontamination processes, it has been established that certain organic reagents can be used to dissolve contamination and yield it to an ion exchange resin in a recirculating process in such a way that the organic reagent is continuously re-used. Examples of solutions used in acidic reactor decontamination processes are vanadous formate, picolinic acid and sodium hydroxide. Other processes typically use mixtures of citric acid and oxalic acid. These reactor decontaminating solutions have the disadvantage of not being capable of being used in a single one time application to dissolve actinides, radium, and certain fission products, such as technetium.

Previous reactor decontaminating solutions do not contain carbonate and are acidic, dissolving the iron oxides of the radioactive elements commonly found in contaminated reactor circuits. This nonselective metal dissolving capacity is a disadvantage of the acidic solutions and makes them unsuitable for decontamination of material such as soil that contains iron and other metals that are not intended to be recovered. Another disadvantage of acidic solutions is that materials such as concrete or limestone are subject to damage or dissolution in an acidic medium. Also, in dealing with previously known washing solutions for treating soil, these solutions contain too many nonselectively dissolved contaminants preventing subjection of the solution to recovery of contaminants and recirculation of the solution to accomplish further decontamination.

It has been established that uranium and transuranic radioactive elements can be dissolved in concentrated acidic ($pH<1$) chemical systems. The acidity poses difficulties as discussed above. Uranium and sometimes thorium are recovered in mining operations in a concentrated basic medium containing carbonate. The use of concentrated solutions is motivated by the need to dissolve materials at a rate economic for mining operations, and such solutions are not particularly suitable where avoidance of secondary waste is of primary concern. There are also references that suggest that uranium and plutonium can be dissolved in a dilute basic solution containing carbonate, citrate (as a chelating agent) and an oxidizing or reducing agent. Such solutions are not, however, suitable for the recovery of radium/barium sulfate because they do not form soluble complexes from barium sulfate.

SUMMARY OF THE INVENTION

This invention relates to the recovery of radioactive elements, especially technetium, radium, and actinides such as thorium, uranium and transuranic elements, from certain types of contaminated materials. These materials could be natural, such as soil, or man-made materials, such as concrete or steel, which have become subject on a large scale to contamination.

The process of the present invention provides that contaminated material is contacted with a dilute, basic, carbonate recirculating dissolving composition that dissolves radioactive contaminants. Contaminated material can be fed in to the process and cleaned material removed continuously therefrom. The contaminants are recovered from the solution by ion exchange, selective adsorption, reagent destruction, filtration or a combination of these techniques. The recovery steps concentrate the contaminants for recovery in such a way that non-residual reagent constituents do not build up in the system.

The recirculating dissolving composition can be applied to small particulate materials such as soil in a contained vessel, or to large standing objects such as concrete walls, or steel structures.

It is an object of the invention to provide a method to dissolve and concentrate radioactive contaminants from materials. Another feature of the invention is that the concentrated contamination can be further processed for recovery or disposal.

It is a further object of the invention to provide a method for the decontamination of soil and the recovery of radioactive contaminants, which uses a dilute basic carbonate solution to achieve dissolution, thereby minimizing risks of environmental or safety hazards, or structural damage.

It is an object of the invention to use chemical systems that dissolve the contaminants in a material as selectively as possible and avoid the dissolution of metals, such as iron and lead.

It is another object of the present invention to use a recirculating dissolving system wherein secondary chemical waste is avoided, and reagents do not build up in concentration during the application of the process.

DETAILED DESCRIPTION OF THE PREFERRED EMBODIMENT

Figure 1:
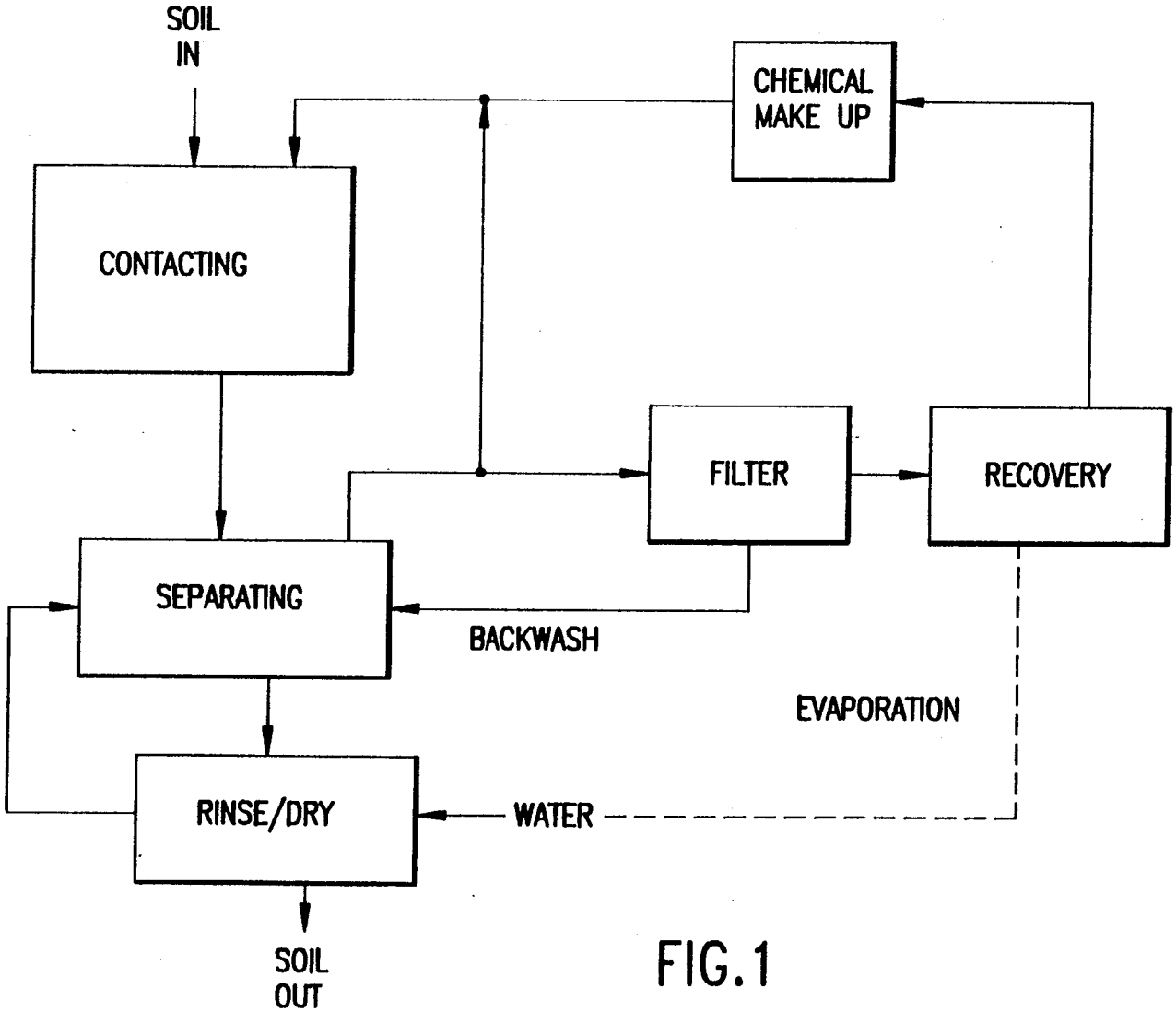
FIG. 1 is a schematic diagram of the preferred embodiment of the present invention.

The present invention provides a process for decontaminating radioactive material. The first step comprises contacting the material to be decontaminated with a dissolving composition. A typical process of the present invention for decontaminating soil is shown in FIG. 1. The contactor device could be any one of a number of standard types—hydropulper, agitation tank, or any other device typically used or suitable for the contact of soils with a liquid medium. A counter current contactor is a standard system which allows solution to flow in the opposite direction to the soil through a series of contacts and solid/liquid separations. Thus the final contact is between emerging soil and uncontacted dissolving composition, the initial contact is between entering soil and already contacted dissolving composition. The contacting step of the dissolving process also includes the step of agitating the material with the dissolving composition. This is useful when the material is a particulate such as soil. Dry soil is fed into a contactor in which it is agitated with the dissolving composition. Agitation of the soil and the dissolving composition occurs for a sufficient time to allow the contaminant to be dissolved in the solution.

The dissolving composition comprises an effective amount of a dilute, basic, carbonate solution, sufficient to dissolve the contaminants in the material. The sources of carbonate include carbon dioxide gas, carbonic acid, sodium carbonate, sodium bicarbonate and other carbonate salts. The carbonate ions form a soluble complex with various actinides. Other anion radicals which are capable of forming soluble complexes with actinides and other radioactive elements can also be used.

The dilute, basic, carbonate solution can further include an effective amount of a chelating agent sufficient to bind a large percentage of the radioactive contaminant. The chelating agent is any molecule that can bind to a radioactive metal ion to form a complex so as to keep the radioactive contaminant in solution. It has been found that a chelating agent is needed for the dissolution of plutonium and other transuranics. The chelating agents of the present process include ethylene diamine tetraacetic acid with an effective concentration of from 0.001 to 0.1 molar with the preferred concentration being about 0.03 molar. Diethylene triamine penta acetic acid, citrate, oxalate and 8-hydroxyquinoline can also be used as chelating agents in this invention.

The dissolving solution has a basic pH, that is, any pH from 7 to 11, and preferably in the range of from about 9 to about 11, with the most preferred pH being about 10. The process includes the step of adjusting the pH of the dissolving composition to about 10 by adding an effective amount of a base, such as sodium hydroxide. The term "base" as used herein includes any substance capable of raising the pH of a solution above pH 7 with the substance not otherwise interfering with the dissolving function of the dissolving composition. Other bases contemplated for use in the solution of the present invention include potassium hydroxide, ammonium hydroxide and ammonium carbonate. Ammonium carbonate is rather noxious, but has the added advantage for waste management that it can be evaporatively recovered from solution (carbon dioxide and ammonia). Any base, according to the above definition, could be used. The amount of base that will be effective to adjust the pH to the preferred range will depend on the specific base used, the other constituents of the solution, and the characteristics of the particular soil or other material being processed.

Alternatively, the carbonate, oxidizing, chelant containing solution of the present process can be used for the dissolution of some actinides at neutral pH.

The process can further include the step of generating carbonate by adding an effective amount of carbon dioxide gas to the dissolving solution prior to the contacting step. The carbon dioxide gas is bubbled through the dissolving composition containing all of the components, except carbonate, to generate a carbonate solution according, for example, to the following equations:

$$CO_2 + H_2O \longrightarrow H_2CO_3 \quad (1)$$

$$2NaOH + H_2CO_3 \longrightarrow Na_2CO_3 + 2H_2O \quad (2)$$

The process of bubbling carbon dioxide gas through the dissolving composition can also be used to adjust the pH of the composition to the appropriate range. The effective amount of carbon dioxide gas sufficient to generate carbonate and adjust the pH of the solution of the instant process can be determined by standard analytical methods. Alternatively, a carbonate solution of the present process can be made by adding an effective amount of a carbonate salt to the dissolving composition. The preferred concentration of carbonate is about 0.06 molar.

The solution of the process can further include an effective amount of an oxidizing agent such as hydrogen peroxide at a concentration of about 1 to about 10 grams/liter of the dissolving composition with the preferred concentration being about 1-3 grams/liter. The oxidizing agent can raise the oxidation state of certain radioactive compounds, such as uranium oxide, to facilitate their dissolution in the carbonate dissolving composition as shown by the following general equation:

$$UO_2 + H_2O_2 + 3Na_2CO_3 \longrightarrow Na_4UO_2(CO_3)_3 + 2NaOH$$

Oxidizing agents are also needed in the dissolving composition to dissolve plutonium. Other effective oxidizing agents include ozone, air and potassium permanganate.

The preferred decontaminating solution of this invention comprises about 0.03 molar ethylene diamine tetraacetic acid, about 0.06 molar carbonate, about 3 grams/-liter hydrogen peroxide and an effective amount of sodium hydroxide so that the solution can be adjusted to a pH from about 9 to about 11. Solutions comprising other effective amounts of the above constituents that are sufficient to dissolve radioactive contaminants in soil and other materials are also contemplated. Such solutions can comprise about 0.01 to about 0.05 molar ethylene diamine tetraacetic acid, about 0.02 to about 0.08 molar carbonate and about 1 to about 10 grams/-liter hydrogen peroxide.

The dissolving composition thus far described is effective at dissolving radioactive contaminants in soil and other materials when the basic, carbonate solution constitutes about two percent or less than two percent of the total concentration by weight of the dissolving composition. Thus, the dilute, basic, carbonate solution in accordance with the described invention is a solution that constitutes less than or about equal to two percent of the dissolving composition. Concentrations of up to 5% are also contemplated. Although higher concentrations of the solution will work, they can have the disadvantages of other concentrated solvent solutions. The balance of the dissolving composition can comprise a suitable liquid, such as water, that is preferably about neutral in pH and inert with regard to the radioactive contaminant.

An alternative dissolving composition of the present invention was published in EPRI Report "Disposal of Radioactive Decontamination Solution Wastes," PPRI-NP 3655, Project 2012-9, Final Report, September, 1984. This report provides a dissolution chemistry for actinides consisting of:

| | |
|---|---|
| Hydrogen Peroxide | 17 gm/l |
| Sodium Carbonate | 26.5 gm/l |
| Sodium Bicarbonate | 21 gm/l |
| 8-Hydroxyquinoline | 1.0 gm/l |
| EDTA | 3.5 gm/l |

This formulation would be suitable for use in the decontamination process of the instant invention.

Uranium can be dissolved through carbonate chemistry, due to the solubility of the carbonate complexes of high oxidation states of uranium. Carbonate systems are preferred for dissolution in the present process, because they do not have the disadvantages of strong acid solvents. If uranium is present in an oxidation state lower than (VI), it is necessary to have an oxidizing agent present for dissolution to occur. Technetium is recoverable in solution under oxidizing conditions as the pertechnetate ion. For the dissolution of uranium and technetium, hydrogen peroxide is the preferred oxidizing agent.

In general, carbonate systems are not capable of achieving easy dissolution of transuranic elements in the absence of a chelating agent. Radium is rather insoluble in a carbonate system, but can be dissolved under alkaline conditions. In many cases of environmental contamination, radium is associated with barium sulfate, which has been added or formed while ore is being leached to recover uranium or thorium, with the purpose of holding radium back in the tailings. According to the present invention, ethylene diamine tetraacetic acid, diethylene triamine penta acetic acid or similar chelants can be used to assist dissolution of the barium sulfate and hold radium in solution. Adjustment of the pH of such a solution by bubbling with carbon dioxide gas yields a solution at appropriate pH for the selective capture of radium by cation exchange. It is known that ethylene diamine tetraacetic acid complexes of alkaline earth elements have different stabilities, and use is made of this feature in analytical separations that cause heavier alkaline earth elements to be held on a cation exchange column while lighter ones are eluted as ethylene diamine tetraacetic acid complexes. (Lawrence B. Farabee in Oak Ridge Report ORNL-1932, September 1955.)

Although the above-described dissolving composition is effective at dissolving a variety of actinides and other radioactive elements bound to solids, the exact formulation of the dissolving composition will depend on the material to be decontaminated. The advantage of the decontamination of the present invention is that it minimizes dissolution of substances that are not intended to be recovered. To determine the exact formula to be used, a sample of the material to be decontaminated, such as soil, is qualitatively and quantitatively analyzed in the laboratory and the dissolving composition is tailored to the character of the material sample.

The following equations generally illustrate the dissolution chemistry of this invention:

Uranium:

$$UO_2 + H_2O_2 + 3Na_2CO_3 \longrightarrow Na_4UO_2(CO_3)_3 + 2NaOH$$

Thorium:

$$2H_2O + ThO_2 + 3Na_2CO_3 \longrightarrow Na_2Th(CO_3)_3 + 4NaOH$$

A further step in the decontamination process is separating the dissolving composition containing the dissolved contaminants from the contacted material. As used herein, the term contacted material means material (soil or other) that has been subjected to the contacting step. The separating step of the decontamination process can be a continuous process that preferably includes the steps of removing a selected amount of the contacted material and replacing continuously the removed material with a selected amount of material to be contacted. The continuous process preferably includes the further steps of removing a selected amount of the dissolving composition that has contacted the material and replacing the removed dissolving composition with a selected amount of recirculated or, alternatively, previously uncontacted dissolving composition.

With the decontamination of soil, some or all of the slurry of soil and dissolving composition passes to a device for separating the soil from the dissolving composition to yield a liquid stream and a thick slurry. Solid-liquid separating can be achieved by settler, lamella thickener, hydrocyclone, filter, or any other device typically used or suitable for solid-liquid separation of particles. Additionally, for in-situ applications, the intent is to recover the contaminant while returning any entrained soil to the site. In this application, a magnetic separation recovery is used for collection of the contaminant. Selective magnetic particles (e.g., composite particles consisting of magnetite and selective adsorbers) are injected into the solvent, which adsorbs the contaminant. The contaminant is removed from the solution by magnetic filtration recovery of the particles (and adsorbed contaminant).

The amount of material and dissolving solution removed and replaced in the continuous separation step will be selected to ensure that the material is sufficiently decontaminated. In the present process, sufficient decontamination is considered to occur when removal from the material of up to 90% or more of the radioactive contaminants found in the material prior to the decontamination process is accomplished. Other continuous separation parameters include the frequency of removal and replacement of material and dissolving composition and the amount of the dissolving composition which is returned directly to the contacting step after separation from the material, as discussed below. The continuous separation parameters can be varied predictably in accordance with the nature of the particular contaminant or contaminants and their ease of dissolution in the dissolving composition of the contacting step.

After separating a selected amount of the dissolving composition from a selected amount of the material, the separated material is in the form of a thick slurry. The thick slurry passes to a device for de-watering the material and a wash liquid, such as water, is used to remove residual dissolving composition from the material during the drying process. When decontaminating a solid object, the decontaminating solution can be contacted with the object's surface and separated by gravity from the object for passage to a recovering step.

Further provided in the decontamination process is a step for recovering radioactive contaminants from the dissolving composition containing the dissolved contaminants that have been separated from the contacted material as described herein. The recovering step includes filtering the dissolving composition that has been separated from the contacted material to remove particulates. The particulates of concern are particles of the material being decontaminated that are carried over with the dissolving composition from the separating step, which can interfere with the subsequent recovery steps. Preferably, a backwashable filter is used in the filtering step.

A further recovering step is the step of adsorbing the contaminants contained in the dissolving composition on an adsorbent ion exchange medium. The process of removing dissolved ions from solution by an ion exchange resin is usually termed adsorption. The adsorbents contemplated in the present process include the standard cation and anion exchangers, and selective adsorbents. The specific adsorbent can be chosen to result in either selective or nonselective adsorption of contaminants dissolved in the dissolving composition.

Typical examples of ion exchangers include strong base anion exchanger such as AMBERLITE IRA 400 Rohm and Haas, Philadelphia, Pa.), a type of quaternary ammonium functionalized styrene/divynyl benzene polymer. An example of a cation exchange resin is AMBERLITE IR-120 (Rohm and Haas, Philadelphia, Pa.), a type of sulfonic acid functionalized styrene/-divynyl benzene polymer. Inorganic cation exchangers, also called selective adsorbents, include manganese dioxide, hydrous titanium oxide and zirconium phosphate. Alternatively, organic chelating ion exchangers (e.g., resorcinol arsonic acid) may be utilized for selective recovery.

Ion exchange is one process used for concentrating the desired constituents from the leached solutions. The resin ion exchange technique involves the interchange of ions between the aqueous solution and a solid resin. This provides for a highly selective and quantitative method for recovery of uranium and radium and other actinides. Anion exchangers may be used for recovery of the thorium, uranium and transuranic complexes from solution. Anion exchange can also be used to recover the pertechnetate ion.

An example of the chemistry of anion exchange adsorption for the recovery of uranium is shown by the equation:

$$UO_2(CO_3)_3^{4-} + 4(\text{Resin}^+-OH^-) \longrightarrow 4(\text{Resin}^+)-UO_2(CO_3)_3^{4-} + 4OH^-$$

Ion exchange can also be used to achieve selective recovery of the contaminants dissolved in the decontaminating solution by selecting carefully the chemical conditions in which standard ion exchangers, such as cation exchangers, interact with the solution. In such a case the cation exchanger acts like a selective adsorbent, even though it is the solution chemistry and not the exchanger which is causing selectivity.

Selective adsorbents, including those listed above, can be formed as large particles in ion exchange columns for the adsorption of contaminants in the recirculating dissolving composition. Selective adsorbents operate by removing radioactive contaminants from the dissolving composition, but in other respects they do not significantly alter the process chemistry. They are thus particularly well-suited to use in the process of the present invention. Alternatively, the selective adsorbents can be added to the solution, or bound to magnetic particles and then filtered from the solution using conventional filtration techniques, micro- or ultrafiltration or magnetic filtration in the case where the ion exchange function is attached to a magnetic particle.

An illustration of the chemistry of cation exchange or selective adsorption for the recovery of uranium is provided by the equation (where $MnO_2$ is used to denote a cation exchange site on manganese dioxide):

$$UO_2(CO_3)_3^{4-} + 2(MnO_2)-H \longrightarrow (2MnO_2)^2-UO_2^{2+} + 2HCO_3^- + CO_3^{2-}$$

If the adsorption step described above uses an ion exchange resin or other matrix for adsorbing the contaminant, the recovery step can further include the step of eluting the adsorbed contaminant from the resin or other matrix to obtain a concentrated solution of the contaminant. Eluting the contaminant is accomplished by means of a solution that removes the contaminant from the adsorbent. The eluting solution, also known as an eluant, can be predictably chosen to be selective for the specific contaminant based on known characteristics of the contaminant and the adsorbent. A typical eluant is an acid such as nitric acid at an intermediate concentration of about 1.0 molar. The degree to which the contaminant is concentrated in the eluant can be varied according to the specific eluant used, but will, in any case, be more concentrated than in the unprocessed contaminated material.

Alternatively, solvent extraction could be used for selective recovery of contaminants from the recirculating solution, but the consequent entrainment of solvent in the recirculating solution is a disadvantage of this approach. Other separation processes commonly used for solution separations such as reverse osmosis or electrodialysis could, in principle, also be used to achieve recovery of contaminants from the recirculating solution.

In some embodiments of the present invention, recovery of contamination by reagent destruction is achieved by raising temperature to or approaching the boiling point of water. Raising temperature is particularly effective when hydrogen peroxide forms one part of the reagent system. The hydrogen peroxide is decomposed by heat (to oxygen and water) and will destructively oxidize chelants in the presence of a suitable metal ion catalyst at close to boiling temperature. Without the chelant present, the contaminant will no longer be soluble. The oxidation of ethylene diamine tetraacetic acid by hydrogen peroxide is illustrated by the following equation:

$$17\ H_2O_2 + C_{10}N_2H_{16}O_8 \longrightarrow 10\ CO_2 + 20\ H_2O + 2\ NH_4OH$$

The step of recovering radioactive contaminants can further include the step of recirculating to the contacting step the dissolving composition that has been separated from the contacted material. Specifically, the recirculating step calls for returning directly to the contacting step a selected amount of the dissolving composition that contains the dissolved contaminants. The step of recirculating also contemplates returning to the contacting step the dissolving composition from which the contaminants have been recovered in the recovery step.

The parameters of the recirculating step include selecting the amount of dissolving composition that will be returned directly to the contacting step and selecting the amount that will proceed to the recovering step before being returned to the contacting step. These and other parameters can be predictably set based on the known characteristics of the material being processed and the nature and quantity of the radioactive contaminants involved. In a typical embodiment, about 10% of the dissolving composition will be recirculated after passing through the recovery step and about 90% will be returned directly to the contacting step. The invention also contemplates batch processing of the dissolving composition wherein the selected amount returned directly to the contacting step is about zero percent and the amount returned to the contacting step after processing through the recovery step is about one hundred percent.

The present invention also provides means for controlling the fluid volume in the recirculating step. The control of fluid volume in the process can be achieved in two ways. Either the soil leaving the process can have a higher water content than that entering, or evaporation can be used to recover pure water from the dissolving solution. One of these or other suitable methods can be utilized to prevent the buildup of the fluid volume.

The present invention also provides a composition for dissolving radioactive contaminants in a material, comprising a dilute solution having a basic pH and effective amounts of a chelating agent and a carbonate sufficient to dissolve radioactive contaminants. The composition of this invention can further include an effective amount of an oxidizing agent sufficient to raise the oxidation state of an actinide, such as uranium or other radioactive element. The preferred dissolving composition includes a solution of about 0.03 molar ethylene diamine tetraacetic acid, about 0.06 molar carbonate, about 3 grams/liter hydrogen peroxide and an effective amount of sodium hydroxide so that the solution can be adjusted to a pH from about 9 to about 11.

The concentration of each constituent of the dilute solution of the dissolving composition of this invention can be varied in a manner such that the solution remains capable of dissolving radioactive contaminants in materials such as soil at a total concentration of about 2% or less than about 2% of the dissolving composition. Dissolving compositions containing up to 5% of the solution components can be effectively used. The balance of the dissolving composition not comprising the dilute basic carbonate solution can be comprised of water or some other liquid that is inert and has an approximately neutral pH.

The following examples are illustrative of the present invention:

EXAMPLES

Example 1—Contamination and Decontamination of Soil with Uranium and Thorium An environmental soil sample was collected. Leachable uranium and thorium in the soil was determined by exposing a soil sample (2 grams) to a leaching procedure. The sample was placed in a beaker with 20 $cm^3$ reagent grade nitric acid. After the reaction subsided, more nitric acid was added until no further reaction took place. Then 5 cm: reagent grade hydrochloric acid was added. The temperature was raised to near boiling for two hours with stirring. After cooling, the solution was filtered and analyzed for uranium and thorium. The analytical method employed Arsenazo III to develop complexes with uranium and thorium, which could then be determined from their colorimetric absorption at 665 nm (thorium) or 655 nm (uranium). Ascorbic acid was added as a reducing agent and the absorbance was measured at 2.5 molar acid to determine thorium first. Diethylene triamine pentaacetic acid was used as a masking agent to determine uranium at pH 2.0–2.1 and the absorption due to uranium was obtained by applying a correction for the absorption due to thorium. The results showed the soil sample to contain 656 ppm uranium and 35 ppm thorium.

The soils were then "spiked" with uranium and thorium to increase the contamination level by the following procedure. 10 grams of dried soil was contacted with 10 $cm^3$ of uranyl acetate and thorium nitrate solution, having 1,000 ppm of each contaminant. This was left to stand overnight. The spiking solution was separated from the soil sample by filtration and its uranium and thorium concentrations determined. The soil was then washed three times with 20 $cm^3$ water and the uranium and thorium concentrations in the wash water were determined for all three washings, in order to establish that the contaminants were not being removed from soil by the water washing process alone. The final concentrations of uranium and thorium on the spiked soil were determined by the acid leaching procedure described above, yielding 1,398 ppm uranium and 1,086 ppm thorium.

Figure 2:
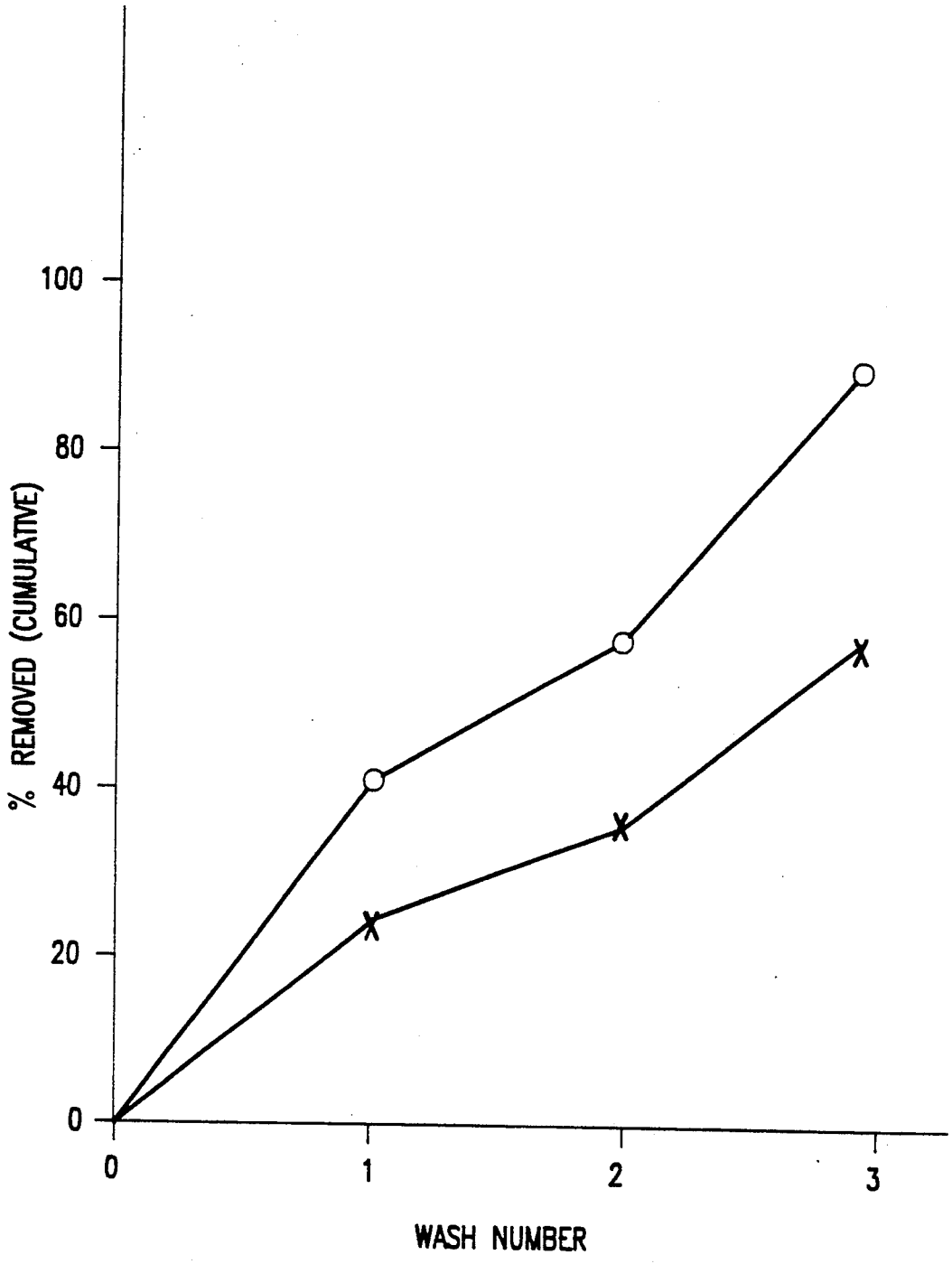
FIG. 2 is a graph showing the data from Example 1.

The soil was then contacted with a dissolving composition containing 0.05 moles per liter ethylene diamine tetraacetic acid and 0.2 moles per liter sodium carbonate, adjusted to pH 10 with sodium hydroxide. The dissolving composition was applied at the rate of 100 $cm^3$ per 5 grams of soil. Three washes of the dissolving composition were applied (under agitation using a magnetic mixer), without rinsing between, to simulate the behavior in a countercurrent contactor. The concentrations of uranium and thorium in the dissolving composition were analyzed as described above and the amount recovered in each wash is shown in FIG. 2.

The first aliquot of dissolving composition was separated from the contacted soil. The uranium and thorium were recovered by passing the dissolving composition through a strong base anion exchange resin column in the carbonate form. The following equations illustrate the anion exchange recovery chemistry for uranium and thorium:

$$UO_2(CO_3)_3^{4-} + 4(Resin^+-OH^-) \longrightarrow 4(Resin^+)-UO_2(CO_3)_3^{4-} + 4OH^-$$

$$[Th(CO_3)_3]^{2-} + 2(Resin^+-OH^-) \longrightarrow 2(Resin^+)-Th(CO_3)_3^{2-} + 2OH^-$$

The amount of uranium and thorium remaining in the dissolving composition after it was run through the column was analyzed, indicating 92% adsorption of thorium and 93% uranium on the column.

The leachable uranium and thorium remaining in the soil after decontamination was determined by acid leaching of the soil as described above. The amounts of uranium and thorium dissolved by strong acid leaching were 528 and 232 ppm, and the experiment summary is shown in Table 1.

Example 2—Recovery of Radium and Barium Sulfate

Radium was coprecipitated on barium sulfate in the following way. 50 ml of barium chloride dihydrate solution (4.5 grams/liter) was prepared and 1 ml of 0.5N hydrochloric acid, containing 12.5 nanocuries Ra-226, was added. To this solution was added 8 ml concentrated sulfuric acid and 12 grams anhydrous potassium sulfate. The solution was allowed to stand for two hours before filtering. 208 milligrams of dried precipitate were recovered.

The amount of radium remaining in solution was analyzed, confirming that radium had been incorporated in the precipitate.

The precipitate was agitated in a dissolving composition of 0.1 molar ethylene diamine tetraacetic acid and 0.1 molar sodium carbonate at pH 9.6. The precipitate had visibly dissolved after 20 minutes, and analysis of the dissolving composition by alpha spectroscopy indicated that the radium adsorbed on the barium sulfate precipitate was present in the dissolving composition. Radium in the dissolving composition can be recovered by selective cation exchange.

Example 3—Contamination and Decontamination of Soil with Plutonium and Americium A sample of soil (10 g) was spiked with plutonium-238 by soaking overnight in 0.1 molar nitric acid (10 ml) containing 2.7 nanocuries Pu-238. After separation from the soil by filtration, the spiking solution was shown to contain less than 1% of the original 2.7 nanocuries of plutonium. A 1 gram sample of the spiked soil was contacted with 250 ml of a dissolving composition which contained 0.02 moles (0.68 grams) per liter of hydrogen peroxide, 0.1 moles per liter citrate and carbon dioxide bubbled through to achieve a pH of 7. After 19 hours it was found that approximately 70% of the plutonium previously present on the soil was present in the dissolving composition that had been separated from the soil. Plutonium and americium can be recovered from the dissolving composition by the same method described in Example 1.

TABLE 1

| | Naturally Present | After Spiking | Dissolved by 1st Wash | Dissolved by 2nd Wash | Dissolved by 3rd Wash | After Decontamination (Calculated) | After Decontamination (Measured) | Removal Efficiency |
|---|---|---|---|---|---|---|---|---|
| Uranium ppm | 656 | 1,398 | 329 | 155 | 316 | 598 | 528 | 62% |
| Thorium ppm | 35 | 1,086 | 408 | 168 | 333 | 177 | 232 | 79% |

What is claimed is:

1. A process for decontaminating material containing radioactive contaminants, comprising the steps of:
   a. contacting the material to be decontaminated with a dissolving composition, the composition comprising an amount of a dilute, basic chelating agent containing carbonate solution sufficient to dissolve the contaminants in the material;
   b. separating the dissolving composition containing the dissolved contaminants from the contacted material; and
   c. recovering the dissolved contaminants from the dissolving composition that has been separated from the material by adsorbing the contaminants contained in the dissolving composition on an anion exchange adsorbent.

2. The process of claim 1, wherein the chelating agent is ethylene diamine tetraacetic acid having a concentration from about 0.001 molar to about 0.1 molar in the dissolving composition.

3. The process of claim 1, wherein the chelating agent is selected from the group consisting of diethylene triamine penta acetic acid, citrate, oxalate and 8-hydroxyquinoline.

4. The process of claim 1, wherein the dissolving composition has a pH from about 9 to about 11.

5. The process of claim 1, further comprising the step of adjusting the pH of the dissolving composition to about 10 by adding an effective amount of sodium hydroxide.

6. The process of claim 1, further comprising the step of generating carbonate by adding an effective amount of carbon dioxide gas to the dissolving composition prior to the contacting step.

7. The process of claim 1, wherein the solution further comprises an effective amount of an oxidizing agent sufficient to raise the oxidation state of a radioactive contaminant.

8. The process of claim 7, wherein the oxidizing agent is hydrogen peroxide, and the effective amount is from about 1 to about 3 grams per liter of the dissolving composition.

9. The process of claim 1, wherein the dilute, basic, carbonate solution comprises about 98% by weight water.

10. The process of claim 1, wherein the contacting step further comprises the step of agitating the material with the dissolving composition.

11. The process of claim 1, wherein the step of separating the dissolving composition from the material is a continuous process and comprises the steps of:

a. removing continuously a selected amount of contacted material; and b. replacing continuously the removed material with material to be contacted.

12. The process of claim 1, wherein the step of separating the dissolving composition from the material further comprises the steps of:

a. removing continuously a selected amount of the dissolving composition that has contacted the material; and b. replacing continuously the removed dissolving composition with dissolving composition.

13. The process of claim 1, wherein the recovering step further comprises the following steps:

a. filtering the dissolving composition that has been separated from the contacted material to remove particulates prior to adsorbing the contaminants on the anion exchange adsorbent; and b. eluting the contaminants from the adsorbent to obtain a concentrated solution of the contaminants.

14. The process of claim 1, further comprising the step of recirculating to the contacting step the dissolving composition that has been separated from the contacted material.

15. The process of claim 14, further comprising controlling the fluid volume in the recirculating step by evaporating water from the dissolving composition.

16. The process of claim 14, further comprising controlling the fluid volume in the recirculating step by allowing water to leave the recirculating step with the decontaminated material.

17. The process of claim 14, wherein the recirculating step comprises returning directly to the contacting step a selected amount of the dissolving composition that contains the dissolved contaminants.

18. The process of claim 1, further comprising recirculating to the contacting step the dissolving composition from which the contaminants have been recovered in the recovering step.

19. A process for decontaminating material containing radioactive contaminants comprising the steps of:

a. contacting the material with a dissolving composition to dissolve the contaminants in the material, said composition comprising a dilute solution of about 0.03 molar ethylene diamine tetraacetic acid, about 0.06 molar carbonate, about 3 grams per liter hydrogen peroxide and an effective amount of sodium hydroxide to adjust the pH of the composition to a pH from about 9 to about 11;

b. separating the dissolving composition containing the dissolved contaminants from the contacted material; and c. recovering dissolved contaminants from the dissolving composition that has been separated from the material.

20. The process of claim 19, wherein the dilute solution of ethylene diamine tetraacetic acid, carbonate, hydrogen peroxide and sodium hydroxide comprises less than about two percent of the total weight of the dissolving composition.

21. The process of claim 1, wherein the radioactive contaminants comprise a radionuclide or mixture of radionuclides selected from the group consisting of uranium, thorium, radium, plutonium and americium.

22. A process for decontaminating material containing radioactive contaminants, comprising the steps of:

a. contacting the material to be decontaminated with a dissolving composition, the composition comprising an amount of a dilute, basic, carbonate solution sufficient to dissolve the contaminants in the material;

b. separating the dissolving composition containing the dissolved contaminants from the contacted material; and c. recovering dissolved contaminants form the dissolving composition that has been separated form the material, by adsorbing the contaminants contained in the dissolving composition on an a cation exchange adsorbent.

23. A process for decontaminating material containing radioactive contaminants, comprising the steps of:

a. contacting the material to be decontaminated with a dissolving composition, the composition comprising an amount of a dilute, basic, chelating agent containing, oxidizing agent containing carbonate solution sufficient to dissolve the contaminants in the material;

b. separating the dissolving composition containing the dissolved contaminants from the contacted material; and c. recovering dissolved contaminants from the dissolving composition that has been separated from the material by precipitating the contaminants contained in the dissolving composition by destructively oxidizing the chelating agent.

24. A process for decontaminating material containing radioactive contaminants, comprising the steps of:

a. contacting the material to be decontaminated with a dissolving composition, the composition comprising an amount of a dilute, basic, chelating agent containing carbonate solution sufficient to dissolve the contaminants in the material;

b. separating the dissolving composition containing the dissolved contaminants form the contacted material; and c. recovering dissolved contaminants from the dissolving composition that has been separated from the material, by adsorbing the contaminants contained in the dissolving composition on a selective inorganic cation exchange adsorbent.

* * * * *